US005572309A

United States Patent [19]

Nishio et al.

[11] Patent Number: 5,572,309

[45] Date of Patent: Nov. 5, 1996

[54] IMAGE FORMING APPARATUS WITH IMPEDANCE DETECTION

[75] Inventors: Yukihito Nishio, Gojo; Shirou Wakahara, Osaka; Hirokazu Fujita, Nara, all of Japan

[73] Assignee: Sharp Kabushiki Kaisha, Osaka, Japan

[21] Appl. No.: 382,912

[22] Filed: Feb. 3, 1995

[30] Foreign Application Priority Data

Feb. 4, 1994 [JP] Japan ..... 6-012969

[51] Int. Cl.[6] ..... G03G 21/00

[52] U.S. Cl. ..... 399/389; 399/388

[58] Field of Search ..... 355/308, 309, 355/311; 377/24

[56] References Cited

U.S. PATENT DOCUMENTS

| | | | |
|---|---|---|---|
| 3,916,171 | 10/1975 | Throp | 355/308 |
| 4,610,530 | 9/1986 | Lehmbeck et al. | 355/311 |
| 4,641,949 | 2/1987 | Wallace et al. | 355/316 |
| 5,455,664 | 10/1995 | Ito et al. | 355/311 X |

FOREIGN PATENT DOCUMENTS

| | | |
|---|---|---|
| 0463743 | 1/1992 | European Pat. Off. . |
| 0660197 | 6/1995 | European Pat. Off. . |
| 54-96046 | 7/1979 | Japan . |
| 60-260943 | 12/1985 | Japan . |
| 2-209284 | 8/1990 | Japan . |
| 3-107772 | 5/1991 | Japan . |
| 4-204149 | 7/1992 | Japan . |
| 5-105284 | 4/1993 | Japan . |

OTHER PUBLICATIONS

European Search Report.

*Primary Examiner*—William J. Royer

*Attorney, Agent, or Firm*—David G. Conlin; Brian L. Michaelis

[57] ABSTRACT

A recording material recognizing device which enables a detection determining whether or not the recording material has passed and a detection determining the width of the recording material to be performed at one time, and also enables a detection determining a thickness, a resistance and a dielectric constant, of the recording material to be performed when physical values of the recording material are also required for stabilizing an image quality.

15 Claims, 10 Drawing Sheets

IMAGE FORMING APPARATUS WITH IMPEDANCE DETECTION

FIELD OF THE INVENTION

The present invention relates to a recording material recognizing device designed for a printing device and a printer for forming a visible image on a recording material from an electric image signal, or OA (Office Automation) apparatuses such as a copying machine, a facsimile machine, etc., for outputting an image using the printing machine, the printer, etc.

BACKGROUND OF THE INVENTION

As a known method for forming a visible image on a recording material from an electrical image signal, the method called xerography is generally used. In this method, first, an electrostatic pattern (electrostatic latent image) is formed on a visualizing member including a photoconductive layer having an electro-optical property by optical writing means, and by making visualizing particles (hereinafter referred to as toners) adhere onto the electrostatic pattern, the static pattern is visualized. Thereafter, the toner on the visualizing member is transferred onto a recording material, thereby visualizing the image signal onto the recording material as a visible image.

More concretely, using a light emitting device (element) such as a laser, LED (Light Emitting Diode), etc., an image signal is converted into an optical signal, and the light beam is projected on the photoconductive layer having been uniformly charged beforehand, thereby forming an electrostatic pattern in accordance with the light intensity on the photoconductive layer. Then, charged toner is made to adhere to the electrostatic pattern or trajected so as to form a toner image on the photoconductive layer. (The process is hereinafter referred to as a developing process).

Then, the toner on the visualizing member is sucked onto the recording material electrically and or under pressure. (The process is hereinafter referred to as a transfer process). Therefore, under an applied pressure and/or heat, the toner image is made permanent on the recording material.

Other than the described xerography, an image may be formed using a dielectric drum (visualizing member), a charged particle generator and a charged particle flow control grid. In this method, by controlling the voltage to be applied to the charged particle flow control grid according to an image signal, the flow of the charged particle generated from the charged particle generator is controlled. As a result, a charge pattern based on the image signal is formed on the dielectric drum. Thereafter, the charge pattern is developed using the toner, thereby forming a toner image on the dielectric drum. Then, the toner on the dielectric drum is transferred onto a recording material and is made permanent thereon in the same manner as the previous method.

In the described two image forming methods, the recording material is recognized mainly using a limit switch, etc., and whether or not the recording material has passed is detected under a control of the mechanical contact state using a transportation force from the recording material. Moreover, in order to detect the width of the recording material, a sensor is required separately.

However, in order to detect whether or not the recording material exists using the limit switch, since components including a sensor, etc., are required for detecting the width of the recording material,i the problem is presented in that a greater number of components is required. Moreover, in the case of using the limit switch, since the detection is carried out under a control using the mechanical contacts an operation error due to contact inferiors is likely to occur.

Other than the method using the limit switch, a method using an electrostatic capacity for detecting whether or not the recording material exists and detecting the size of the recording material has been proposed. The method is disclosed in Japanese Laid-Open Patent Publication No. 260943/1985 (Tokukaisho 60-260943). This method is applicable to a detector. However, when the method is applied to the detector, an electrode which covers an area of the recording material is required.

Recently, a method for directly forming a toner image on the recording material without using the visualizing member has been proposed. In this method, using the charged particle flow control grid controlled based on the image signal, the charged toner is selectively and directly trajected onto the recording material so as to form the toner image on the recording material. Thereafter, the toner image is made permanent on the recording material in the same manner as the previously described methods.

In this method, since the visualizing member for forming the electrostatic pattern based on the image signal can be eliminated, a simplified structure and compact size of the image forming apparatus can be achieved.

However, when forming an image without using the visualizing member, physical properties (thickness, dielectric constant and changes in these properties due to environmental changes, etc.,) of the recording material will affect the trajection of the toner. Therefore, as in the described method, the detection by the limit switch, the detection determining whether or not the recording material has passed based on changes in electrostatic capacity, the detection determining the width of the recording material using the sensor, etc., are not sufficient to recognize the recording material. Therefore, the problem is presented in that a stable image quality according to the physical properties of the recording material cannot be ensured.

Another method is disclosed in Japanese Laid-Open Patent Publication No. 204149/1992 (Tokukaihei 4-204149), wherein an image forming operation is controlled by measuring the surface resistance of the recording material. However, in this method also, components including a sensor, etc., are separately required for detecting the width of the recording material, thereby presenting the problem of increasing the number of components.

SUMMARY OF THE INVENTION

The first objective of the present invention is to provide a recording material recognizing device which enables a detection determining whether or not the recording material has passed and a detection determining the width of the recording material to be performed at one time, and also enables a detection determining a thickness, a resistance and a dielectric constant, etc., of the recording material to be performed when physical values of the recording material are also required for stabilizing an image quality.

The second objective of the present invention is to provide a recording material recognizing device designed for an image forming apparatus, which enables a reduction in cost and a smaller space required for the device by reducing the number of components.

In order to achieve the first objective, the recording material recognizing device in accordance with the present invention, includes:

a first electrode provided along a transport path of a recording material, on an upstream side of an image forming section in an image forming apparatus;

a second electrode facing the first electrode, provided in such a position that the recording material passes between the first electrode and the second electrode, wherein at least either one of the first electrode and the second electrode is composed of a plurality of divided electrodes arranged in a widthwise direction of the recording material;

detection means for detecting a current flowing through each of the plurality of divided electrodes with an application of a predetermined voltage across the first electrode and the second electrode; and recognition means for recognizing whether or not the recording material has passed therethrough and a width of the recording material based on results of detection by the detection means.

According to the above arrangement, when the recording material is inserted between the first and second electrodes, an output detected by the detection means changes from the output in the initial state where the recording material is not inserted. Thus, whether or not the recording material has passed can be detected by the recognition means. Moreover, when the recording material is inserted between the electrodes, if the width of the recording material is shorter than the entire length of the arranged divided electrodes, a divided electrode, which forms a space with the other electrode, exists. In the portion where the space is formed, an infinite resistance value is shown. Therefore, compared with the portion where the recording material exists between the electrodes, a greater difference in current is detected by the detection means. Therefore, the recognition means can recognize the width of the recording material by detecting the divided electrode which shows a great change in current.

The amount of change in current detected in the portion where the recording material exists from the current in the initial state differs depending on the material used in the recording material. Therefore, for example, by generating the electric field according to the image signal in a vicinity of the visualizing particle holding member for holding the visualizing particle, the electric field in response to the image signal can be generated. By this electric field, in an image forming process wherein the visualizing particle is made to selectively adhere onto the recording material, by controlling the potential applied for generating the electric field according to the amount of change in current value, a stable image quality can be ensured irrespectively of the material used in the recording material.

As described, with a single measurement of the recording material, i.e., by measuring only the current flowing through the divided electrode between the electrodes which sandwich the recording material, the detection determining the width of the recording material and the detection determining whether or not the recording material has passed can be performed at one time without increasing the number of components. In the image forming apparatus provided with the described recording material recognizing device, a control operation based on the detected values for ensuring a stable image quality can be performed. Furthermore, compared with the conventional method for detecting whether or not the recording material exists using a mechanical contact, etc., an operation error is less likely to occur, thereby enabling more accurate detecting operations.

Additionally, with an application of an alternating voltage across the electrodes, not only the detection determining whether or not the recording material has passed and the detection determining the width of the recording material, but also the detections determining the thickness and the dielectric constant, etc., can be performed. Namely, at least when the recording material is inserted between the electrodes, condensers are formed in the same number as the divided electrodes between the electrodes. Therefore, by detecting the current flowing through the divided electrodes, the electrostatic capacity of each condenser can be calculated. Here, divided electrodes which for a space between themselves and other electrodes are formed depending on the width of the recording material. Since the electrostatic capacity detected in the portion where the space is formed varies depending only on the thickness of the recording material, the recognition means can detect the thickness of the recording material by detecting the amount of change in electrostatic capacity of the portion where the space is formed.

On the other hand, the electrostatic capacity in the portion where the recording material exits between the electrodes varies according to the thickness and the dielectric constant of the recording material. Since the thickness of the recording material can be detected as described, only the dielectric constant remains unknown. Therefore, the recognition means can recognize the dielectric constant and the resistance of the recording material only by calculating the electrostatic capacity between the electrodes which sandwich the recording material. Then, the image forming operation can be controlled based on the detected values such as the thickness, dielectric constant and resistance, etc., of the recording material.

As a result, since the recording material recognizing device in accordance with the present invention permits the physical values of the recording material, environmental changes, etc., to be easily detected, in the image forming apparatus provided with the recording material recognizing device, under a control according to the physical values, a more stable image quality can be ensured irrespectively of the material used in the recording material.

In order to achieve the second objective of the present invention, the recording material recognizing device in accordance with the present invention which is provided in an image forming section of an image forming apparatus, the image forming section being arranged such that under an applied potential according to an image signal to an electrode array placed between a visualizing particle holding member for holding a visualizing particle by an electrostatic force or a magnetic force and a counter electrode facing the visualizing particle holding member, an electric field for selectively trajecting the visualizing particle toward the counter electrode from the visualizing particle holding member is generated in a vicinity of the visualizing particle holding member, so that the visualizing particle selectively adheres to a recording material based on the image signal, the recording material recognizing device comprising:

impedance detection means for detecting an impedance between the counter electrode and the electrode array; and recognition means for recognizing a width of the recording material as well as whether or not the recording material has passed therethrough.

In the image forming apparatus having the described arrangement, condensers are respectively formed between the counter electrode and the electrode array. Since the electrostatic capacity of the condenser changes when the recording material is inserted between the counter electrode and i the electrode array, the recognition means can determine whether or not the recording material has passed by detecting the impedance between the counter electrode and the electrode array. Moreover, even when the recording material is inserted, depending on the width of the recording material, a portion where the recording material is placed and a portion where the recording material is not placed may be formed. In this case, the impedance of the portion where the recording material is not placed is almost the same as the impedance detected when the recording material is not inserted. Therefore, by detecting the position of the electrode array subject to changes in impedance, the recognition means can determine the width of the recording material.

Furthermore, the impedance detected in the portion where the recording material is placed changes according to the material used in the recording material. Since the changes in impedance affects the electric field generated in a vicinity of the visualizing particle holding member, by controlling the potential applied to the electrode array based on the detected impedance, a stable image quality can be ensured.

As described, in the image forming section of the image forming apparatus, the detection determining whether or not the recording material has passed and the detection determining the width of the recording material can be performed at one time with accuracy. Since the described arrangement requires a smaller number of components, reduction in cost and a smaller space required for the device are enabled.

For a fuller understanding of the nature and advantages of the invention, reference should be made to the detailed description taken in conjunction with the accompanying drawings.

BRIEF DESCRIPTION OF THE DRAWINGS

FIG. 1(*b*) is a typical depiction showing a recognizing mechanism adopted in the recording material recognizing device of FIG. 1(*a*).

FIG. 1(*c*) is an explanatory view showing changes in impedance detected by the recording material recognizing device of FIG. 1(*a*).

enlarged view showing an image forming section in the image forming apparatus.

Figure 4:
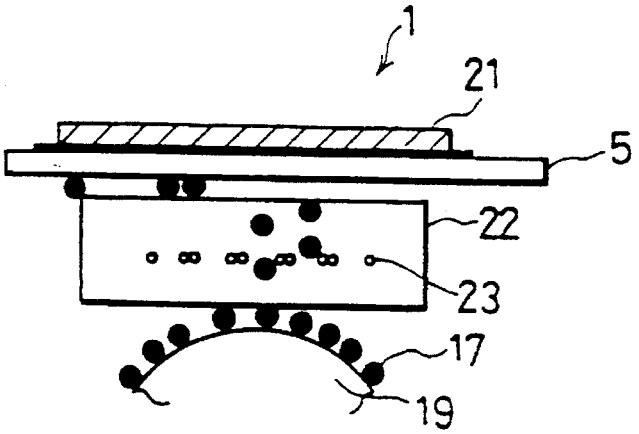

FIG. 4 is an explanatory view showing an image forming operation in the image forming section.

Figure 5:
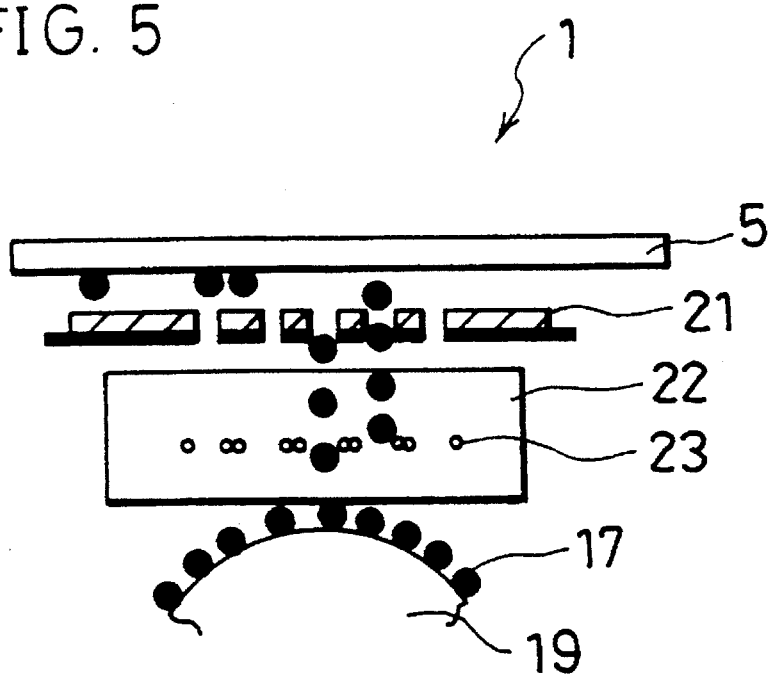

FIG. 5 is an explanatory view showing an image forming operation in an image forming section having another configuration.

Figure 6:
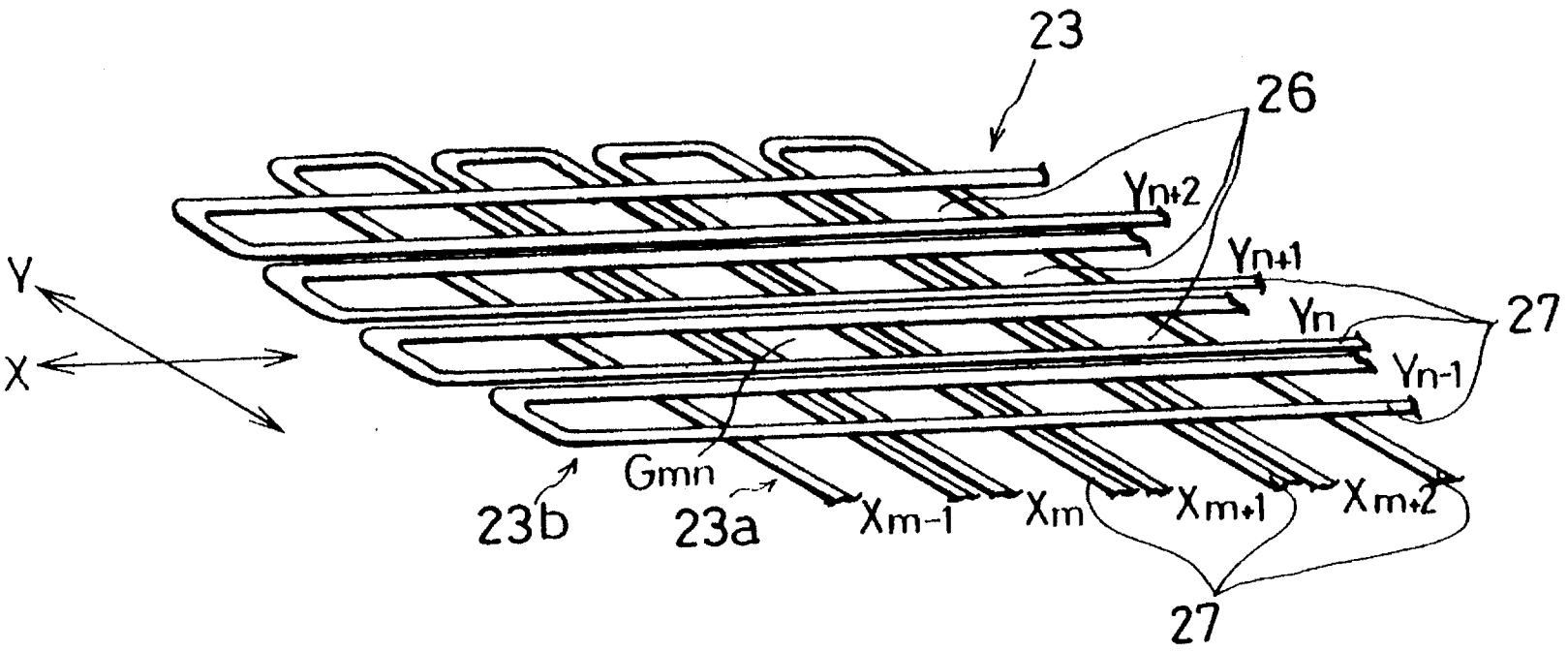

FIG. 6 is a perspective view of the charged particle flow control grid provided in the image forming section.

Figure 7:
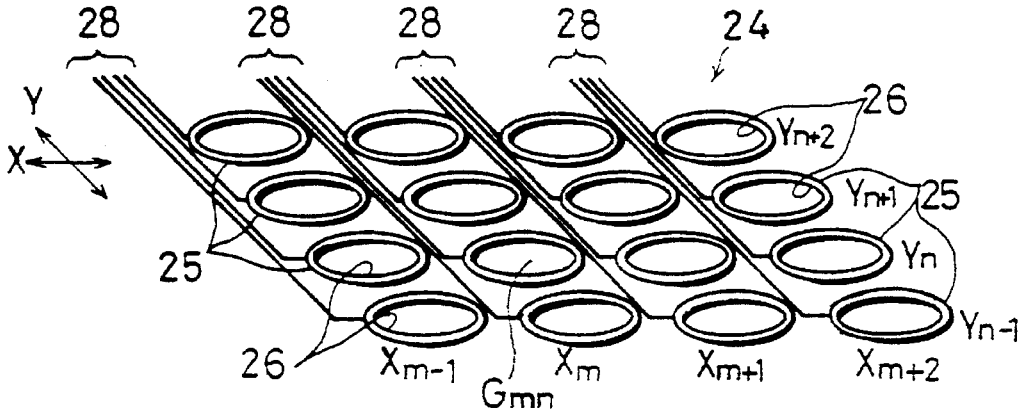

FIG. 7 is a perspective view showing another configuration of the charged particle flow control grid.

Figure 8:
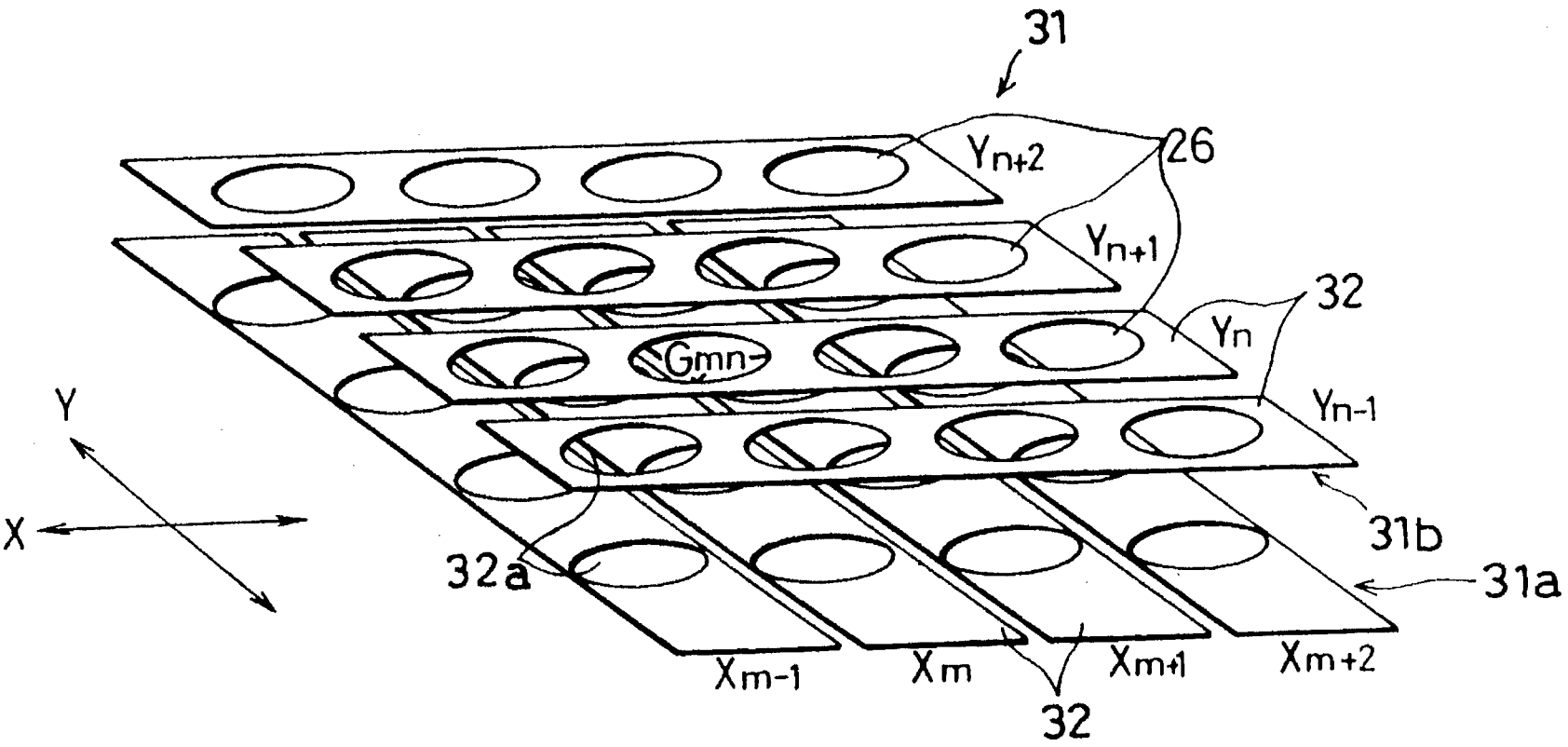

FIG. 8 is a perspective view showing a charged particle flow control grid having still another configuration.

Figure 9:
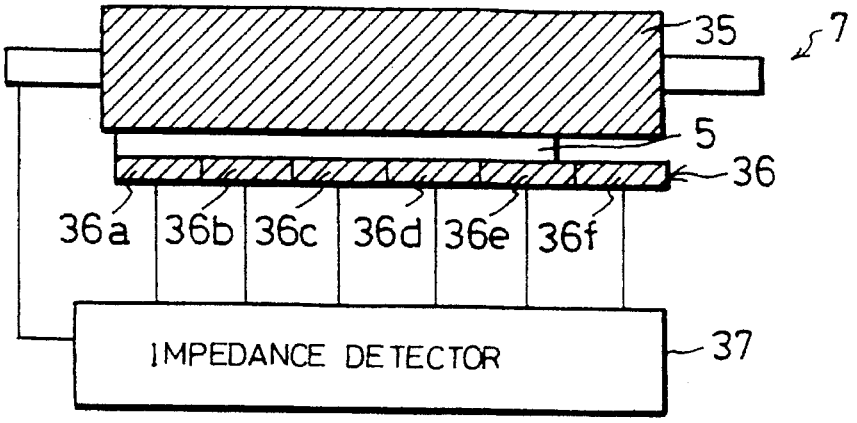
Figure 9:
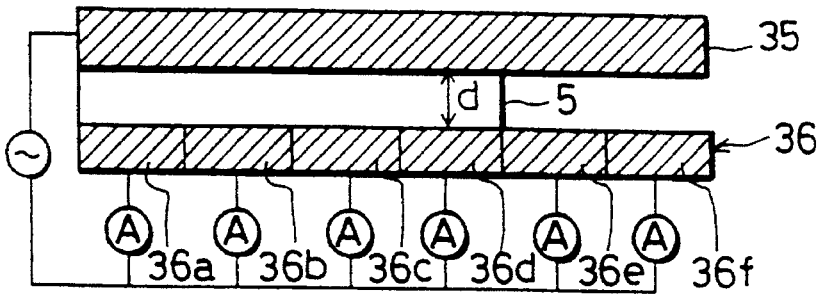
Figure 9:
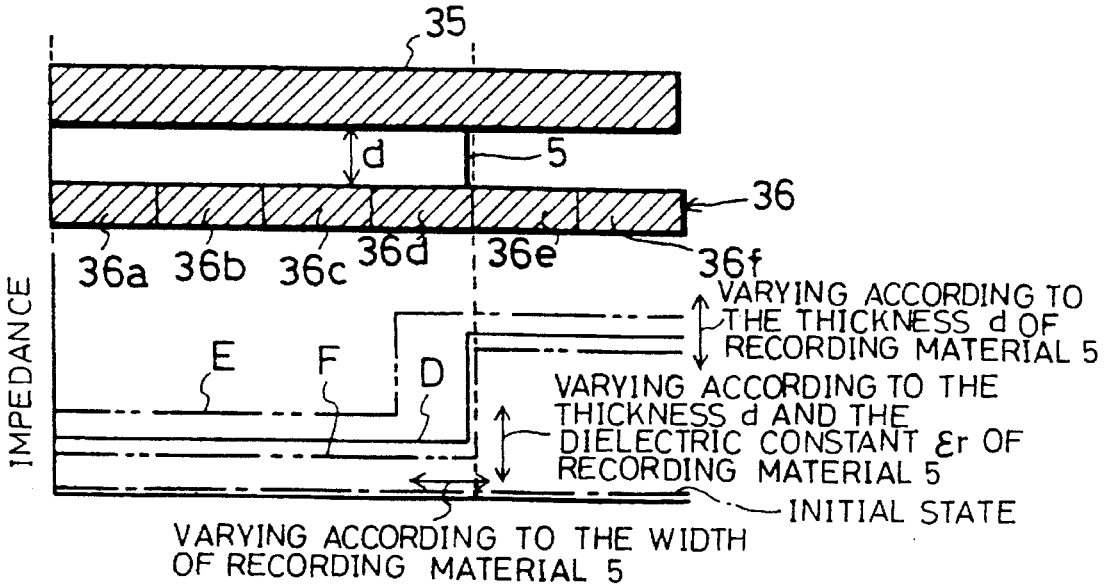

FIG. 9(*a*) is a typical depiction showing another configuration of a recording material recognizing device.

FIG. 9(*b*) is a typical depiction showing the recognizing mechanism of the recording material recognizing device of FIG. 9(*a*).

FIG. 9(*c*) is an explanatory view showing changes in impedance detected by the recording material recognizing device of FIG. 9(*a*).

Figure 10A:
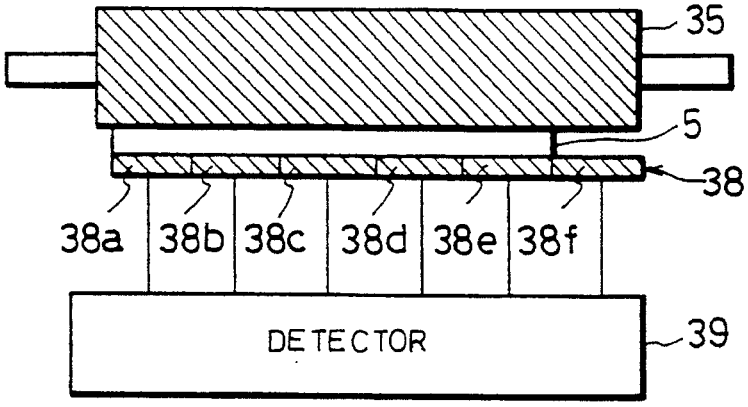
Figure 10B:
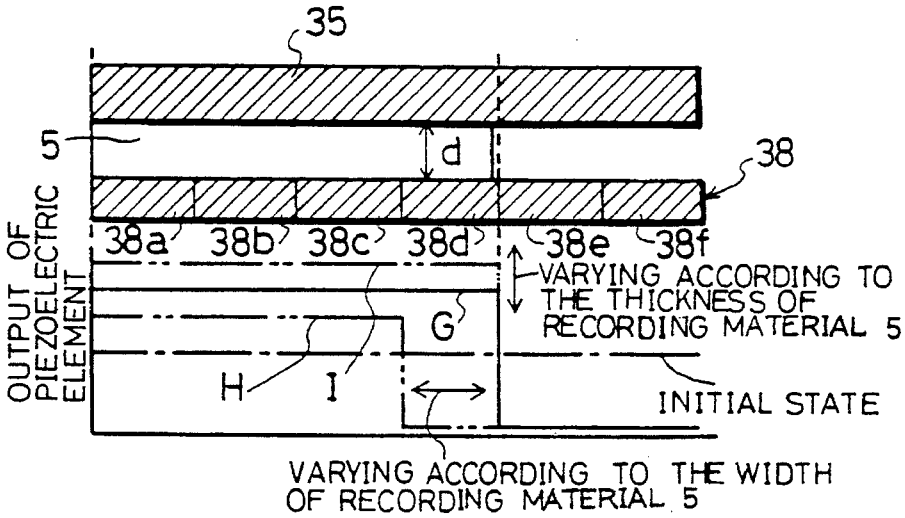

FIG. 10(*a*) is a typical depiction showing the configuration of the recording material recognizing device in accordance with another embodiment of the present invention.

FIG. 10(*b*) is an explanatory view showing changes in output of a piezoelectric element detected by a recording material recognizing device.

Figure 11A:
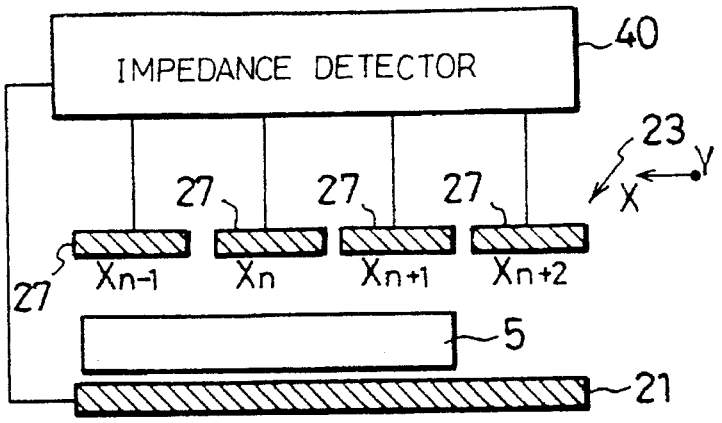
Figure 11B:
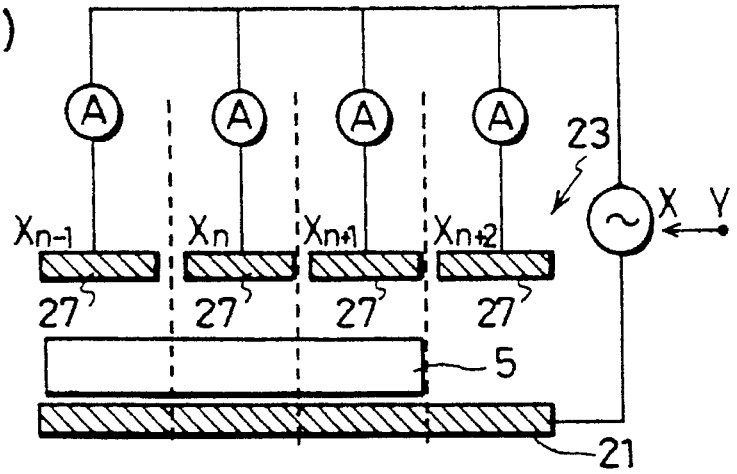
Figure 11C:
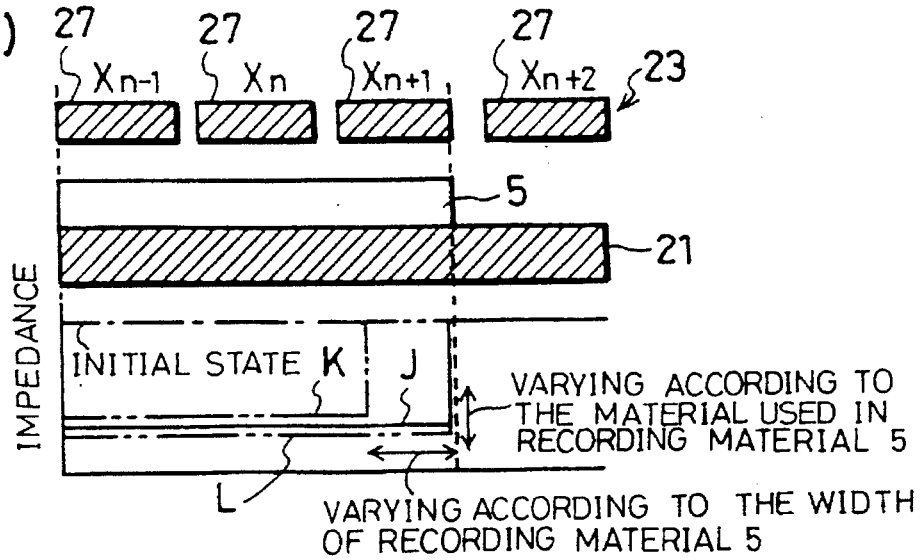

FIG. 11(*a*) is a typical depiction showing the configuration of a recording material recognizing device in accordance with still another embodiment of the present invention.

FIG. 11(*b*) is a typical depiction showing the recognizing mechanism in the recording material recognizing device.

FIG. 11(*c*) is an explanatory view showing changes in impedance detected by the recording material recognizing device of FIG. 11(*a*).

DESCRIPTION OF THE EMBODIMENTS

[EMBODIMENT 1]

The following descriptions will discuss one embodiment of the present invention in reference to FIG. 1 through FIG. 9.

Figure 2:
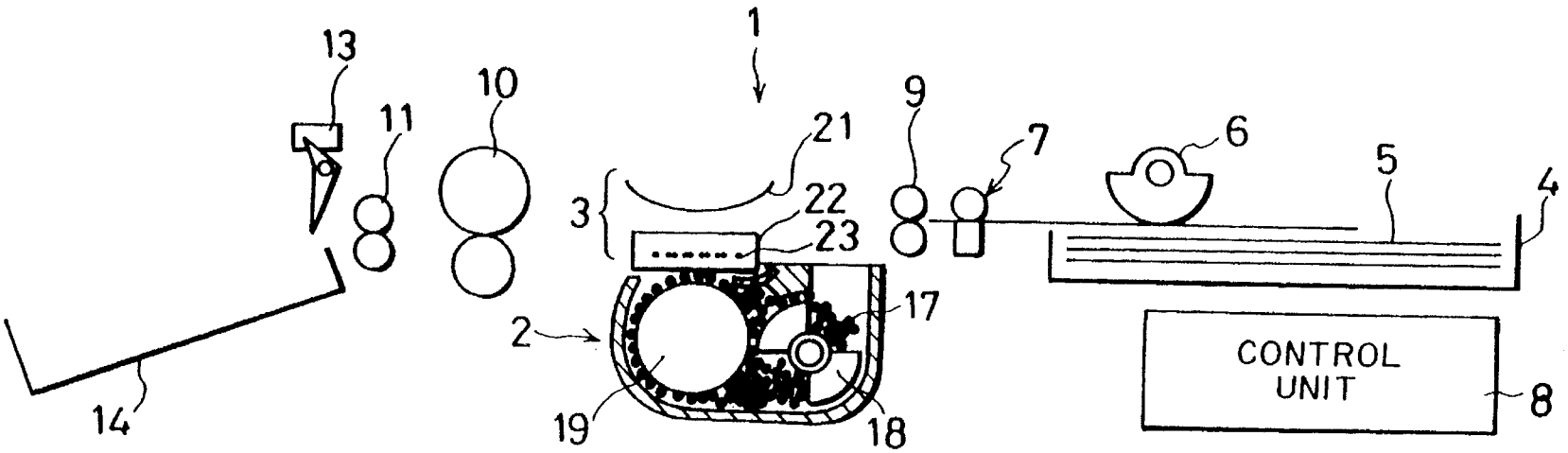
FIG. 2 is a typical depiction showing the configuration of an image forming apparatus adopting the recording material recognizing device.

As shown in FIG. 2, an image forming apparatus having a recording material recognizing device in accordance with the present embodiment is provided with an image forming section 1 including a toner supply section 2 and a printing section 3. The image forming section 1 is provided for visualizing an image according to an electric image signal on a recording material 5 such as a sheet, etc., using a toner 17 (visualizing particle).

On the recording material 5 supply side of the image forming section 1, a recording material storing section 4, a supply roller 6, a feed sensor 7 and a register roller 9 are provided. The recording material storing section 4 stores therein the recording material 5, and the recording material 5 stored therein is fed by the supply roller 6, and physical values of the recording material 5 are measured by the feed sensor 7. The register roller 9 feeds the recording material 5 transported from the recording material storing section 4 to the image forming section 1 at a predetermined timing. A detection signal from the feed sensor 7 is inputted into a control unit 8, and the control unit 8 (recognition means) controls an entire image forming section based on mainly the detection signal from the feed sensor 7. The recording material recognizing device in accordance with the present embodiment is composed of the feed sensor 7 and the control unit 8.

On the other hand, on the recording material 5 discharge side of the image forming section 1, a fusing section 10, a discharge roller 11, a discharger sensor 13 and a tray 14 are provided. In the fusing section 10, a toner image formed on the recording material 5 by the image forming section 1 is made permanent under an applied heat and/or pressure. The discharge roller 11 discharges the recording material 5 processed in the fusing section 10 onto the tray 14. The discharge sensor 13 detects the recording material 5 to be discharged, and the tray 14 receives the discharged recording material 5.

Figure 3:
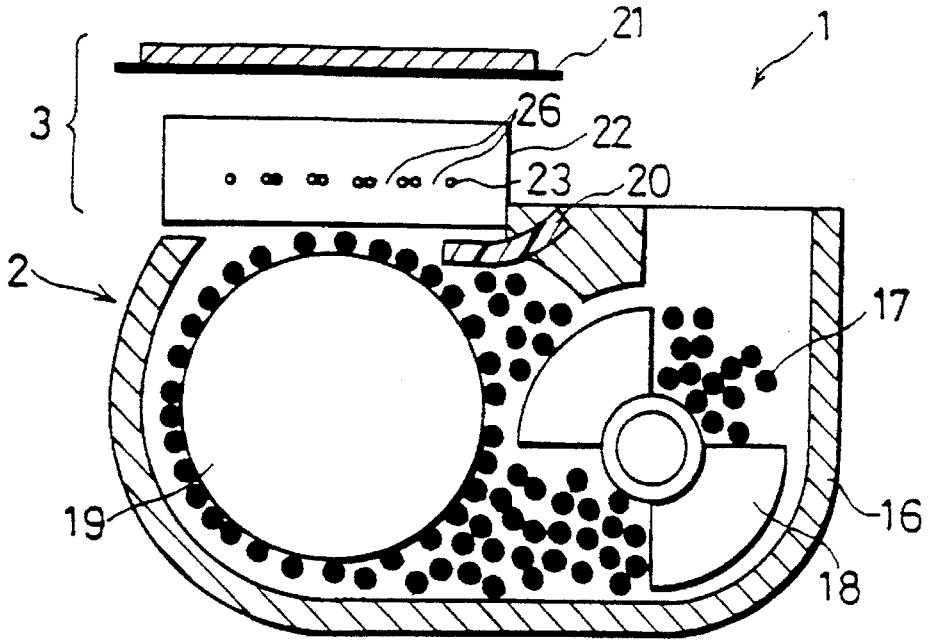

As shown in FIG. 3, the toner supply section 2 of the image forming section 1 is arranged so as to store the toner 17 (visualizing particle) inside a developer frame 16. The toner supply section 2 includes therein a stirring roller 18 and a cylindrical toner holding member 19 (visualizing particle holding member). The stirring roller 18 charges the toner 17 by stirring, and the toner holding member 19 holds the toner 17 using an electric force and/or magnetic force. The thickness of the toner layer being held on the circumference of the toner holding member 19 is controlled by a doctor blade 20 provided on the developer frame 16.

The printing section 3 includes a counter electrode 21 placed above the toner holding member 19 and a print head 22 placed between the counter electrode 21 and the toner holding member 19. The counter electrode 21 is composed of, for example, a plate-like electrically conductive member placed parallel to a tangent plane of the toner holding member 19, and an electrically conductive cylindrical member having an axis parallel to the toner holding member 19 or the part of the cylindrical member.

In a vicinity of the toner holding member 19, an electric field having either stronger or weaker intensity than the toner trajection initiating electric field is applied. Here, the electric field required for initiating the trajection of the toner 17 is referred to as a toner trajection initiating electric field Eth. This is an electric field required for initiating the trajection of the toner 17 held on the toner holding member 19 induced by an applied voltage across the toner holding member 19 and the counter electrode 21. In an experiment, the toner trajection initiating electric field Eth was $1.0\times10^6$ V/m.

The print head 22 includes a charged particle flow control grid 23 (electrode array). A voltage is applied from the power supply to the charged particle flow control grid 23 based on a grid control signal outputted from the control unit 8 according to an image signal or a detection signal from the feed sensor 7. The charged particle flow control grid 23 is placed parallel to the counter electrode 21 in a two-dimensional space so as to face the counter electrode 21. The charged particle flow control grid 23 has a structure for permitting a toner flow from the toner holding member 19 to the counter electrode 21. The voltage to be applied to the charged particle flow control grid 23 as well as the voltage to be applied to the counter electrode 21 and the toner holding member 19 are controlled by the control unit 8 so as to control the electric field in a vicinity of the print head 22, thereby selectively trajecting the toner 17 on the toner holding member 19 towards the counter electrode 21.

The image forming process using the toner 17 in the image forming section 1 is performed by the following mechanism. In general, when the charged particle is placed on an interface between air (vacuum) and a substance, a suction force is generated between the interface from the substance and the charged particle by an electrostatic force. This is a known fact in the field of electromagnetics. Therefore, the toner 17 adheres onto the surface of the toner holding member 19 by the electrostatic force. In this state, if an electric field having a higher intensity than the electromagnetic suction force between the toner 17 and the toner holding member 19 is applied onto the surface of the toner holding member 19, the toner 17 becomes separated from the toner holding member 19, and is accelerated to move in a specific direction by a force of the electric field.

Here, using the potential to be applied to the charged particle flow control grid 23, and the potential relationship between the toner holding member 19 and the counter electrode 21, an electric field which allows the toner 17 being held on the toner holding member 19 to be trajected to the counter electrode 21 is generated. Then, as shown in FIG. 4, by this electric field, the toner 17 is trajected to the counter electrode 21 through the charged particle flow control grid 23 as shown in FIG. 4. In this case, the potential to be applied to the charged particle flow control grid 23 is controlled based on the image signal, and when the recording material 5 is fed between the counter electrode 21 and the print head 22, the toner image based on the image signal is formed on the surface of the recording material 5.

FIG. 4 shows the case where the recording material is fed between the counter electrode 21 and the print head 22. However, the transport path of the recording material 5 differs depending on the shape of the counter electrode 21 and also depending on whether or not a hole is formed in the counter electrode 21. More specifically, in the case of adopting a cylindrical counter electrode 21 or a plate-like counter electrode 21 without a hole, the recording material 5 is fed between the counter electrode 21 and the print head 22. On the other hand, in the case of adopting a plate-like counter electrode 21 (not limited to a flat plate) with a hole, as shown in FIG. 5, the recording material 5 is transported in such a state that the counter electrode 21 is placed between the recording material 5 and the print head 22, i.e., the recording material 5 is placed opposite the print head 22 with the counter electrode 21 in between.

As shown in FIG. 6, the charged particle flow control grid 23, for example, has a double layer mesh structure made of linear wire rods. The charged particle flow control grid 23 includes a plurality of control electrodes 27 made of a linear wire rod with one end being folded back in a parallel direction. Namely, X-channel layers **23*a* are formed by placing the control electrodes 27 parallel to the X-direction, and by placing the control electrodes 27 parallel to the Y direction, the Y-channel layers 23*b* are formed. Then, the mesh structure is formed by the X-channel layers 23*a* and the Y-channel layers 23*b*. Here, the vertical relationship between the layers 23*a* and 23*b*** are not specified.

In the charged particle flow control grid 23, a space between the lines in the control electrode 27 is an opening for a gate 26. Namely, a space formed by two parallel lines in the single control electrode 27 of the X-channel layer **23*a* and two parallel lines in the single control electrode 27 of the Y-channel layer 23*b* crossing the control electrode 27 is the gate 26. The toner 17 trajected from the toner holding member 19 passes through the gate 26**.

In the case of adopting the charged particle flow control grid 23 having the described mesh structure made of linear wire rods, in order to control the two-dimensional gate 26 independently, different potentials are required independently for the X-channel layer **23*a* and the Y-channel layer 23*b*. Additionally, a pair of wire rods facing one another which form the gate 26 are constituted by the same control electrodes 27** with one end folded back, and thus have the same potential.

In the described arrangement, the gate 26 is placed in a two-dimensional space, and when the transport direction of the recording material 5 in the printing section 3 is designated by the Y-direction, the gate 26 including at least two lines of the gate 26 are formed in the Y-direction. Moreover, when the loops of the wire in X and Y directions are respectively designated by $X_m$-channel and $Y_n$-channel, the gate 26 surrounded by the wire rods of the $X_m$-channel and the $Y_n$-channel is indicated as $G_{mn}$.

The voltage to be applied to the control electrodes 27 are controlled by the control unit 8. By this voltage and the potential relationship between the toner holding member 19 and the counter electrode 21, an electric field for trajecting the toner 17 being held on the toner holding member 19 to the counter electrode 21 can be generated on the surface of the toner holding member 19. Furthermore, by adjusting the intensity of the electric field, the amount of the toner 17 passes through each gate 26 can be controlled.

The structure of the charged particle flow control grid is not limited to the described mesh structure, and the charged particle flow control grid shown in FIGS. 7 and 8 may be used in place of the charged particle flow control grid 23.

The charged particle flow control grid 24 shown in FIG. 7 is a plate like electrode with a hole. More specifically, in the electrically conductive control electrode substrate, a hole is formed as a gate 26, and a ring-shaped conductive member which is insulated from the control electrode substrate is formed as the control electrode 25 by an evaporation method, etc.

As to the control electrode 25, a plurality of arrays are formed in a two-dimensional space in X and Y directions which are orthogonal to one another. As described, an inner portion of each control electrode 25 serves as a gate 26 as a through section for passing therethrough the toner trajected from the toner holding member 19 to the counter electrode 21. The gate 26 formed at the intersection between the $X_m$ line and the $Y_n$ line in the control electrode 25 is indicated as $G_{mn}$. Here, the transport direction of the recording material 5 in the printing section 3 is designated by the Y direction, and the gate 26 including at least two lines is formed in the Y-direction. Each control electrode 25 is connected to a feed wire 28, and the two-dimensional gate 26 is controlled independently according to a control signal from the control unit 8.

The charged particle flow control grid 31 shown in FIG. 8 has a double layer plate structure with a hole, and a plurality of long plate-like control electrodes 32 are formed in parallel. Namely, in the control electrode 32, a plurality of circular openings 32*a* are formed in a lengthwise direction. This opening 32*a* serves as the gate 26 for passing therethrough the toner 17. By arranging the control electrode 32 in the Y-direction, the X-channel layer 31*a* is formed, and by arranging the control electrode 32 in the X-direction, the Y-channel layer 31*b* is formed. Then, the charged particle flow control grid 31 is formed by placing the X-channel layer 31*a* and the Y-channel layer 31*b* so as to be vertically aligned in parallel. In this case, respective openings 32*a* of the X-channel layer 31*a* and the Y-channel layer 31*b* are vertically aligned.

Here, when the transport direction of the recording material 5 in the printing section 3 is set in the Y direction, the gate 26 including at least two arrays in the Y direction is formed. In the control electrode 32, when respective channels in the X and Y directions are designated by $X_m$-channel and $Y_n$-channel, the gate 26 at which the $X_m$-channel and $Y_n$-channel are overlapped is indicated as $G_{mn}$ in the figure.

In this case also, different potentials are applied independently to the X-channel layer 31*a* and the Y-channel layer 31*b*, and the two-dimensional gate 26 is controlled independently.

The feed sensor 7 for measuring the physical values of the recording material 5 will be explained in reference to FIGS. 1(*a*), (*b*) and (*c*).

Figure 1A:
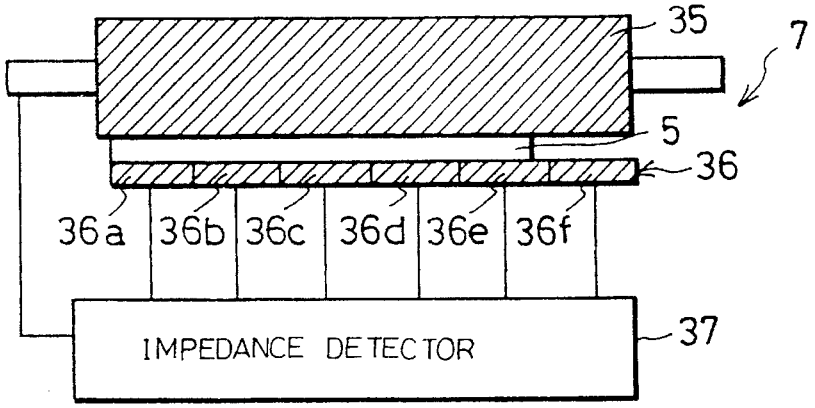
FIG. 1(*a*) is a typical depiction showing a configuration of a recording material recognizing device in accordance with one embodiment of the present invention.
Figure 1B:
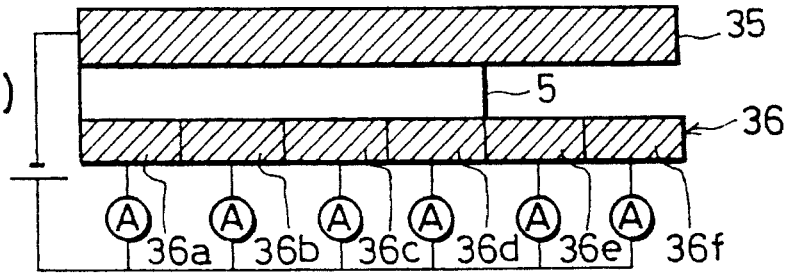
Figure 1C:
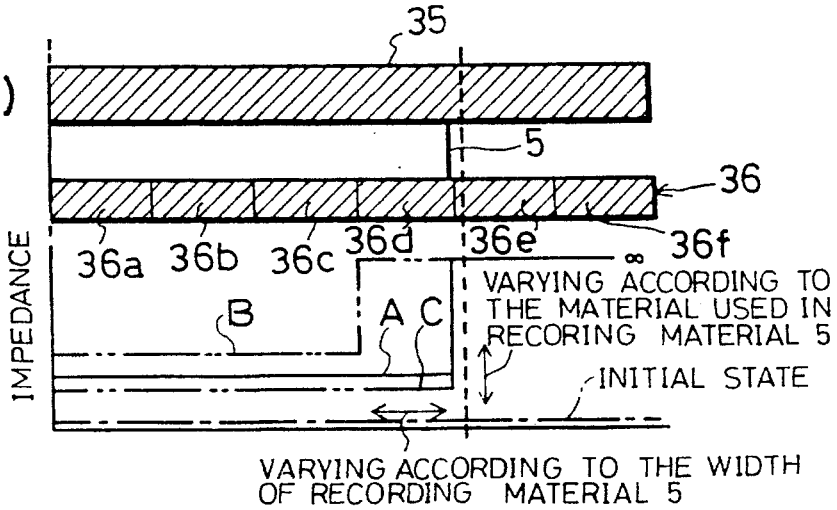

The feed sensor 7 is formed based on the concept shown in FIG. 1(*b*). As shown in FIG. 1(*a*), the feed sensor 7 is provided with an electrically conductive roller-shaped electrode 35 (first electrode), a counter electrode 36 (second electrode) and an impedance detector 37 (detection means) connected to the counter electrode 36. The counter electrode 36 is arranged such that the first through sixth divided electrodes 36*a*–36*f* are arranged in the widthwise direction of the recording material 5. The impedance detector 37 detects each current flowing through the first through sixth divided electrodes 36*a*–36*f* under an applied predetermined DC power across the electrically conductive roller-shaped electrode 35 and the counter electrode 36. In the described manner, the impedance detector 37 detects an impedance (resistance value) between the electrodes 35 and 36 in each of the divided electrodes 36*a*–36*f*, and the detected values are outputted to the control unit 8.

When the transportation of the recording material 5 is started, and the recording material 5 passes between the electrically conductive roller-shaped electrode 35 and the counter electrode 36, a space corresponding to the thickness of the recording material 5 is formed between the electrically conductive roller-shaped electrode 35 and the counter electrode 36. Therefore, the detected impedance varies according to the resistance generated by the recording material 5 placed between the electrodes 35 and 36. The method for detecting the recording material 5 will be explained below in detail.

In the initial state where the recording material 5 has not reached the feed sensor 7, the electrically conductive roller-shaped electrode 35 and the counter electrode 36 are almost in contact with one another. Therefore, in this state, the impedance between the electrodes 35 and 36 is very small as shown by an alternate long and short dashed line in FIG. 1(*c*). In FIG. 1(*c*), the x-axis in the figure indicates a position of divided electrodes 36*a*–36*f* in the divided counter electrode 36, and the y-axis indicates an impedance. While the recording material 5 being transported is passing between the electrodes 35 and 36, in the portion of the counter electrode 36 in contact with the recording material 5, a change in current occurs, and the impedance appears as shown by A–C in FIG. 1(*c*). Therefore, by detecting a different impedance from the initial state, whether or not the recording material 5 exists can be detected.

The width of the recording material 5 is detected in the following manner. In the case where the width of the recording material 5 is narrower than the width of the counter electrode 36, while the recording material 5 is passing therethrough, a space is formed between the counter electrode 36 and the electrically conductive roller-shaped electrode 35. For example, when the width of the recording material 5 corresponds to the length from the first divided electrode 36*a* to the fourth divided electrode 36*d*, a space is formed between the fifth and sixth divided electrodes 36*e* and 36*f* and the electrically conductive roller-shaped electrode 35. In this case, as shown by A and C in FIG. 1(*c*), in a space between electrodes where the recording material 5 exists (corresponding to first through fourth divided electrodes 36*a*–36*d*), the resistance value limited for the recording material 5 is shown. On the other hand, in a space between electrodes where the recording material 5 is not placed (corresponding to the fifth and sixth divided electrodes 36*e* and 36*f*), an almost infinite resistance value is shown.

When the width of the recording material 5 is only up to the position of the third divided electrode 36c, changes denoted by B in the figure are shown. Namely, in the first through third divided electrodes 36*a*–36*c*, the limited resistance value is shown, and in the fourth through sixth divided electrodes 36*d*–36*f*, an infinite resistance value is shown. The impedance detected for each of the divided electrodes 36*a*–36*f* in the counter electrode 36 varies according to the width of the adopted recording material 5. Therefore, by detecting the electrode of the infinite resistance, the width of the recording material 5 can be detected.

Furthermore, as denoted by A–C in FIG. 1(*c*), the resistance value according to the material (kind) of the recording material 5 is detected. Even when adopting the recording material 5 of the same width, if the material of the recording material 5 varies, the resistance value detected between electrodes where the recording material 5 is placed also varies as denoted by A and C in the figure. Furthermore, the changes in resistance value of the recording material 5 also affects the electric field generated in the image forming section 1. On the other hand, the control unit 8 for receiving the detection signal from the feed sensor 7 controls an electric signal to be outputted to the charged particle flow control grid 23. Since the intensity of the electric field is adjusted by the control unit 8, a desirable quality of the image cab be ensured on the recording material 5 made of any materials.

Alternatively, the following detection method may be used for recognizing the recording material. Under an applied predetermined vibrating voltage between the electrically conductive roller-shaped electrode 35 and the counter electrode 36, the detecting operations for recognizing the recording material 5 are preformed. This detecting operation will be explained in reference to FIGS. 9(*a*), (*b*) and (*c*). The feed sensor 7 is arranged as shown in FIG. 9(*a*) based on the concept shown in FIG. 9(*b*).

When the transportation of the recording material 5 has not started, and the recording material 5 is not placed between the electrodes 35 and 36 (initial state), the impedance is as shown by the alternated long and short dash line in FIG. 9 (*c*). Therefore, when the recording material 5 is transported between the electrodes 35 and 36, whether or not the recording material 5 exists can be detected by comparing the impedance with the impedance in the initial state.

The width and the thickness of the recording material 5 are detected in the following manner. When the recording material 5 passes through a space between the electrically conductive roller-shaped electrode 35 and the counter electrode 36, the impedance detected at every divided electrodes 36*a*–36*f* in the counter electrode 36 are as shown by E–D in FIG. 9(*c*) according to the material, the width, the thickness, etc., of the recording material 5. More specifically, when the recording material 5 passes through a space between the electrically conductive roller-shaped electrode 35 and the counter electrode 36, the electrodes 35 and 36 are apart from one another by a distance corresponding to the thickness d of the recording material 5, and six condensers are formed between the electrically conductive roller-shaped electrode 35 and the counter electrode 36.

For example, when the width of the recording material 5 corresponds to the length from the first divided electrode 36*a* to the fourth divided electrode 36*d*, in the space between the fifth and sixth divided electrodes 36*e* and 36*f* and the electrically conductive roller-shaped electrode 35, the recording material 5 does not exist, and a space is formed. Therefore, the electrostatic capacity between the electrically conductive roller shaped electrode 35 and the counter electrode 36 differs between the portion where the recording material 5 is placed (first through fourth divided electrodes 36*a*–36*d*) and the portion where the recording material 5 is not placed (the fifth and sixth divided electrodes 36*e* and 36*f*). The impedance in this case is denoted by D and F in the figure.

The impedance Z between the electrodes 35 and 36 is represented by the electrostatic capacity C and the power supply frequency f of the power supply as shown by the formula (1).

$$Z=1/2\pi fC \quad (1)$$

The electrostatic capacity C can be expressed using the dielectric constant $\in$, the electrode area S and the distance d between electrodes, and when the vacuum dielectric constant is designated by $\in_0$, the electrostatic capacity $C_0$ between electrodes where the recording material 5 does not exist is expressed by the formula (2).

$$C_0=\in_0 S/d \quad (2)$$

On the other hand, when the dielectric constant of the recording material 5 is designated by $\in_r$, the electrostatic capacity Cr between electrodes where the recording material 5 is placed is represented by the following formula (3).

$$C_r=\in_0\in_r S/d \quad (3)$$

Here, the parameters depending on the recording material 5 are the distance d between electrodes and the dielectric constant $\in_r$.

Therefore, the difference in impedance between the portion where the recording material 5 is placed and the portion where the recording material 5 is hot placed is detected by the impedance detector 37, and by recognizing the interface with a varying impedance (in D and F in the figure, the space between the fourth divided electrode 36*d* and the fifth divided electrode 36*e*, and in E in the figure, the space between the third divided electrode 36*c* and the fourth divided electrode 36*d*), the width of the recording material 5 is determined.

The impedance in the portion where the recording material 5 is not placed is a parameter depending only on the distance d between electrodes (the thickness of the recording material 5). Namely, even with a varying thickness d of the recording material 5, the electrode area S and the vacuum dielectric constant $\in_0$ are always constant, and only the distance between the electrodes is varied according to the thickness d of the recording material 5. Therefore, the electrostatic capacity Co represented by the formula (2) varies according to the thickness d of the recording material 5. Therefore, by recognizing the electrode area S beforehand, the impedance is detected from the portion where the recording material 5 is not placed so as to determine the thickness d of the recording material 5.

Furthermore, as to the impedance of the portion where the recording material 5 is placed, if the thickness d of the recording material 5 is detected, only the dielectric constant $\in_r$ of the recording material 5 is unknown. Therefore, by detecting the impedance of the portion where the recording material 5 is placed for each recording material 5, the respective resistance and the dielectric constant $\in_r$ can be detected according to the material used in the recording material 5. As a result, based on the resistance and the dielectric constant, the control unit 8 controls so as to generate a stable electric field in a vicinity of the print head 22, thereby obtaining a stable image.

Next, an image forming operation to be controlled according to the physical values of the recording material 5 recognized by the feed sensor 7 will be explained in reference to FIG. 2.

When a motor (not shown ) provided in the image forming apparatus is started by a print start signal from a host computer (not shown), the recording material 5 stored in the recording material storing section 4 is fed to the image forming section 1 by the operation of the feed roller 6. Then, when the recording material 5 being transported reaches the feed sensor 7, the feed sensor 7 is activated so as to detect the impedance between the electrically conductive roller-shaped electrode 35 and the counter electrode 36 in the feed sensor 7. The detection signal from the feed sensor 7 is outputted to the control unit 8, and based on the detection signal from the feed sensor 7, whether or not the recording material 5 exists as well as the width of the recording material 5 are detected.

The recording material 5 having passed through the feed sensor 7 is temporarily stored by the register roller 9 in its stoppage. When the control unit 8 receives a signal indicating an accurate feeding of the recording material 5 from the feed sensor 7, the formation of an image signal to be printed is started based on a print signal from the host computer.

After a certain amount of the image signal to be printed (the amount being changed according to the structure of the image forming apparatus, etc.,) is converted into the electric signal to be applied to the print head 22, the control unit 8 activates the motor for driving the register roller 9. Then, the register roller 9 conveys the recording material 5 to the print head 22. When the recording material 5 is fed to the position of the print head 22, the control unit 8 outputs the electric signal converted from the image signal to be printed to the print head 22. The print head 22 controls an electric field in a vicinity of the print head 22 based on the electric signal applied from the control unit 8 under an applied voltage to the charged particle flow control grid 23.

The electric field generated in a vicinity of the print head 22 is affected by a material used in the recording material 5, etc. Further, a portion which is not required to be activated may be formed in the print head 22 depending on the width of the recording material 5. Therefore, in order to stably control the electric field in a vicinity of the print head 22 without being affected by the material used in the recording material 5 and also to send the electric signal only to the required width of the print head 22, a voltage to be applied across the print head 22 and the counter electrode 21 is controlled by the control unit 8 based on the resistance value detected by the feed sensor 7 and the width of the recording material 5 detected based on the resistance value. Moreover, in the case of recognizing the recording material 5 under an applied vibrating voltage, the thickness d of the recording material 5 can be detected in the manner described above. Therefore, if the compensation for the thickness d is also required, the control of the voltage to be applied according to the detected thickness d is equally performed.

With the described control, the control unit 8 sends the electric signal converted from the image signal to the print head 22 in synchronous with the transportation of the recording material 5. As a result, when the recording material 5 is transported to the position of the print head 22, the toner 17 is selectively sent to the counter electrode 21 by the electric field in a vicinity of the print head 22 varied based on the electric signal from the control unit 8. As a result, in the case of adopting the cylindrical counter electrode 21 or the counter electrode 21 of a plate without a hole, the toner 17 is made to adhere to the recording material 5 being transported between the counter electrode 21 and the print head 22, thereby forming an image using the toner 17 on the recording material 5. On the other hand, in the case of adopting the plate-like counter electrode 21 with a hole, the toner 17 thus trajected pisses through the hole formed in the counter electrode 21, and adheres to the recording material 5.

According to the described arrangement, the transportation of the recording material 5 with an image formed thereon using the toner 17 continues to the fusing section 10. In the fusing section 10, pressure and/or heat are applied to the recording material 5 so as to melt the toner 17 on the recording material 5, thereby making the toner image permanent on the recording material 5. Further, transportation of the recording material 5 having passed through the fusing section 10 with the toner image fixed thereon further continues until it is discharged onto the tray 14 by the discharge roller 11. Here, the discharge sensor 13 performs a detection determining whether or not the recording material has been discharged from the image forming apparatus without problem. If so, the detection signal from the discharge sensor 13 is sent to the control unit 8 which determines the completion of the normal printing operation.

As described, the feed sensor 7 is provided along the transport path of the recording material 5, and when the recording material 5 passes between the electrically conductive roller-shaped electrode 35 and counter electrode 36, the impedance is detected so that the control unit 8 can determine whether or not the recording material 5 exists and also determine the width of the recording material 5 based on the detection signal from the feed sensor 7. As a result, according to the width of the recording material 5, the electric signal is outputted only to the required portion of the print head 22. Moreover, the impedance according to the material used in the recording material 5 can be detected, and based on the detected impedance, a voltage applied across the charged particle flow control grid 23 and the counter electrode 21 can be controlled, thereby ensuring a stable image quality.

Furthermore, with an application of a vibrating voltage across the electrically conductive roller-shaped electrode 35 and the counter electrode 36, the feed sensor 7 can perform not only the detection determining whether or not the recording material 5 exists, the detection determining the width and the resistance value of the recording material 5 but also the detection determining the thickness and the dielectric constant of the recording material 5, thereby achieving an accurate control based of the results of the described detection.

Furthermore, according to the arrangement of the present embodiment, since the result of detection can be detected using a single device, without increasing the number of components, an accurate detection can be achieved with a reduced error in detection compared with the case where the detection method using the limit switch, etc., is adopted.

[EMBODIMENT 2]

The following descriptions will discuss another embodiment of the present invention in reference to FIGS. 10(*a*) and (*b*). For convenience, members having the same function as the aforementioned embodiment will be designated by the same reference numerals, and the descriptions thereof shall be omitted here.

A recording material recognizing device of the present embodiment is provided in the image forming apparatus of the first embodiment as a feed sensor. As shown in FIG. 10(*a*), the feed sensor is provided with an electrically conductive roller-shaped electrode 35, a piezoelectric element array 38, and a detector 39 (pressure detection means) connected to i the piezoelectric element array 38. The piezoelectric element array 38 is arranged such that the first through sixth piezoelectric elements 38*a*–38*f* arranged in the widthwise direction of the recording material 5 are incorporated into a counter electrode 36. A pressure applied to each of the piezoelectric elements 38*a*–38*f* is detected by the detector 39 as an output from each of the piezoelectric elements 38*a*–38*f*. Further, an output from the detector 39 is sent to the control unit.

In the state where the transportation of the recording material 5 has not started (initial state), the electrically conductive roller-shaped electrode 35 is in contact with the piezoelectric element array 38 with constant pressure. Here, the output from the piezoelectric element detected by the detector 39 has a level shown by an alternate long and short dash line shown in FIG. 10(*b*). When the recording material 5 is transported between the electrically conductive roller-shaped electrode 35 and the piezoelectric element array 38, the output from the piezoelectric element detected by the detector 39 changes according to the width and the thickness of the recording material 5. As a result, whether or not the recording material 5 exists can be detected.

The width of the recording material 5 is detected in the following manner. For example, as denoted by G and I in FIG. 10(*b*), the pressure applied to the first through fourth piezoelectric elements 38*a*–38*d* in contact with the recording material 5 increases compared with the initial state (in the direction of high pressure). On the other hand, the pressure applied to the fifth and sixth pressure elements 38*e* and 38*f* which are not in contact with the recording material 5, i.e., with a space from the electrically conductive roller-shaped electrode 35, the applied pressure reduces (in the direction of low pressure) compared with the initial state. On the other hand, when the width of the recording material 5 is only up to the third pressure element 38*c*, the pressure reduces after the fourth piezoelectric element 38*d* (see H in FIG. 10(*b*)).

Therefore, by detecting the point at which the output from the piezoelectric element changes from the direction of the increasing pressure to the direction of the reducing pressure based on an output from the detector 39 for detecting changes in pressure from the initial state, the width of the recording material 5 can be recognized.

Furthermore, the pressure applied to the piezoelectric element in contact with the recording material 5 is in proportion to the thickness d of the recording material 5. Therefore, by detecting an increased amount of pressure compared with the initial state, the thickness d of the recording material 5 can be detected.

As described, the control unit which receives an output from the detector 39 detects whether or not the recording material 5 exists, and also the width and the thickness of the recording material 5. Therefore, the width of the electric field generated in a vicinity of the print head 22 can be controlled according to the detected width of the recording material 5, and the voltage to be applied across the charged particle flow control grid 23 and the counter electrode 21 can be controlled so as to achieve a stable image quality.

Therefore, in the present embodiment, without increasing the number of components nor having operation errors, the width of the recording material 5 as well as whether or not the recording material 5 exists can be detected by means of a single Unit. Furthermore, a stable image quality can be ensured only by detecting the thickness of the recording material 5 so as to perform an accurate control for the recording material 5.

[EMBODIMENT 3]

The following descriptions will discuss still another embodiment of the present invention in reference to FIG. 2 and FIGS. 11(*a*)–(*c*). For convenience, members having the same function as the aforementioned embodiments will be designated by the same reference numerals, and the descriptions thereof shall be omitted here.

An image forming apparatus in accordance with the present embodiment has a configuration shown in FIG. 2, and is provided for recognizing the recording material at the portion of a print head 22. In the present embodiment, the recording material 5 is transported between the print head 22 and a counter electrode 21. Based on the concept shown in FIG. 11(*b*), the recording material recognizing device includes control electrodes 27 which constitute the charged particle flow control grid 23 provided in the print head 22, a counter electrode 21 and an impedance detector 40 (detection means) as shown in FIG. 11(*a*).

More specifically, the control electrodes 27 Which form an X-channel layer are connected to the impedance detector 40. Here, the transport direction of the recording material 5 is in a Y-channel direction. The impedance detector 40 detects a current through the control electrode 27 at each channel, and the results of detection by the impedance detector 40 are outputted to the control unit 8.

Between the control electrodes 27 and the counter electrode 21, a predetermined space is formed which serves as a plurality of condensers in parallel. In the initial state where the transportation of the recording material 5 has not started, the impedance is as shown by an alternate long and short dash line as shown in FIG. 11(*c*). When the transportation of the recording material 5 is started and the recording material 5 reaches between the electrodes 27 and 21, the electrostatic capacity of the condenser increases. As shown by formula (1) described in the first embodiment, the impedance is in inverse proportion to the electrostatic capacity. Therefore, with the insertion of the recording material 5, the impedance reduces as denoted by J–L in FIG. 11(*c*) as compared with the initial state. By detecting changes in the impedance, whether or not the recording material 5 exists can be detected.

In the state where the recording material 5 is inserted between the electrodes 27 and 21, the electrostatic capacity of the condenser differs between the portion where the recording material 5 exists and the portion where the recording material 5 does not exist. In formula (3) of the first embodiment, the dielectric constant $\in_r$ of the recording material 5 satisfies the following inequality $\in_r > 1$. Therefore, the electrostatic capacity of the portion where the recording material 5 exists becomes greater than the portion where the recording material 5 does not exist. As shown in the figure, since the impedance is in inverse proportion to the electrostatic capacity, the impedance becomes smaller. Therefore, by detecting the channel of the control electrode 27 at which a sudden increase in impedance has occurred, the width of the recording material 5 can be detected.

In the case where, for example, the width of the recording material 5 is from $X_{n-1}$ to $X_{n+1}$, the impedance appears as denoted by J and L, and the case where the width of the recording material 5 is shorter, the impedance appears as denoted by K in FIG. 11(*c*).

Between the electrodes 27 and 21, a drop in impedance in the portion where the recording material 5 exists varies according to the material used in the recording material 5. Therefore, a voltage applied across the charged particle flow control grid 2B and the counter electrode 21 is controlled based on the detected value of the impedance of each recording material 5 so that a stable image quality can be ensured irrespectively of the material used in the recording material 5.

When the recognition of the recording material 5 at the print head 22 is performed in the described manner, the print head 22 is activated based on the recording material recognition mode and the print mode. Namely, while the recording material 5 is being transported to the image forming section 1, the apparatus is set in the recording material recognition mode, and when the leading end of the recording material 5 reaches between the print head 22 and the counter electrode 21, using the head portion of the recording material 5, on which an image is hardly printed, the detection of the impedance is performed.

After the results of detection are sent to the control unit 8, it is switched to the print mode, and is controlled based on the results of detection, and an electric field is generated in a vicinity of the print head 22, and the image forming operation is performed in the same manner as the first embodiment, thereby forming images on the recording material 5.

With the recognition of the recording material 5 at the print head 22, whether or not a recording material 5 exists as well as the width of the recording material 5, etc., can be detected without increasing the number of components, and the physical values of the recording material 5 can be measured, and the apparatus can be controlled so as to achieve a stable image quality based on the physical values. Along the transport path of the recording material 5 in the image forming apparatus, a sensor, etc., for measuring the physical values of the recording material 5, etc., is not required, thereby simplifying the configuration of the image forming apparatus.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. A recording material recognizing device comprising:

a first electrode provided on a transport path of a recording material, on an upstream side of an image forming section in an image forming apparatus;

a second electrode facing said first electrode, provided in such a position that the recording material passes between said first electrode and said second electrode, wherein at least one of said first electrode and said second electrode is composed of a plurality of divided electrodes arranged in a widthwise direction of the recording material;

detection means for detecting a current flowing through each of said plurality of divided electrodes with an application of a predetermined voltage across said first electrode and said second electrode; and recognition means for recognizing whether or not the recording material has passed therethrough and a width of the recording material based on results of detection by said detection means.

2. The recording material recognizing device as set forth in claim 1, wherein:

the predetermined voltage applied across said first electrode and said second electrode as an alternating voltage, and said recognition means further recognizes resistance, dielectric constant and thickness of the recording material.

3. A recording material recognizing device, comprising:

a first electrode provided on a transport path of a recording material, on an upstream side of an image forming section in an image forming apparatus;

a second electrode facing said first electrode, provided in such a position that the recording material passes between said first electrode and said second electrode, wherein at least one of said first and second electrodes is composed of a plurality of piezoelectric elements arranged in a widthwise direction of the recording material, pressure detection means for detecting changes in pressure in each of said plurality of piezoelectric elements when the recording material passes therethrough under an applied predetermined pressure from another electrode to said plurality of piezoelectric elements; and recognition means for recognizing, based on results of detection by said pressure detection means, thickness and width of the recording material and recognizing whether or not the recording material has passed therethrough.

4. A recording material recognizing device being provided in an image forming section of an image forming apparatus, said image forming section being arranged such that under an applied potential according to an image signal to an electrode array placed between a visualizing particle holding member for holding a visualizing particle by an electrostatic force or a magnetic force and a counter electrode facing the visualizing particle holding member, an electric field for selectively trajecting the visualizing particle toward the counter electrode from the visualizing particle holding member is generated in a vicinity of the visualizing particle holding member, so that the visualizing particle selectively adheres to a recording material based on the image signal, said recording material recognizing device comprising:

impedance detection means for detecting an impedance between the counter electrode and the electrode array; and recognition means for recognizing width of the recording material as well as whether or not the recording material has passed therethrough based on a detected impedance.

5. The recording material recognizing device as set forth in claim 4, wherein:

said counter electrode is composed of a plate-like electrically conductive member placed parallel to a tangent plane of said visualizing particle holding member in cylindrical shape.

6. The recording material recognizing device as set forth in claim 4, wherein:

the counter electrode is a circular electrically conductive plate placed parallel to said visualizing particle holding member.

7. The recording material recognizing device as set forth in claim 4, wherein:

said counter electrode is an electrically conductive cylinder placed parallel to said visualizing particle holding member.

8. The recording material recognizing device as set forth in claim 4, wherein:

said electrode array is a plurality of control electrodes arranged in parallel in a widthwise direction of the recording material.

9. The recording material recognizing device as set forth in claim 8, wherein:

said control electrode is made of a linear material with one end folded back in a parallel direction.

10. The recording material recognizing device as set forth in claim 8, wherein:

said control electrode is made of a ring-shaped conductive member surrounding a hole formed in a control electrode substrate, said ring-shaped conductive member being insulated from said control electrode substrate.

11. The recording material recognizing device as set forth in claim 8, wherein:

said control electrode is composed of a long plate-like electrically conductive member with a plurality of circular openings along a lengthwise direction of the control electrode.

12. A method for recognizing whether or not a recording material exists and width of the recording material, comprising the steps of:

when the recording material passes between first and second electrodes, at least one of which being composed of a plurality of divided electrodes arranged in a widthwise direction of the recording material, detecting a resistance value between said first electrode and said second electrode in each divided electrode; and recognizing whether or not the recording material has passed therethrough and recognizing a resistance value between said first electrode and said second electrode based on each change in resistance value.

13. A method for recognizing whether or not a recording material exists and recognizing width, resistance, dielectric constant and thickness of the recording material, comprising the steps of:

when the recording material passes between a first electrode and a second electrode, at least one of which being composed of a plurality of divided electrodes arranged in a widthwise direction of the recording material, detecting an electrostatic capacity between said first electrode and said second electrode at each divided electrode;

recognizing whether or not the recording material has passed and the width of the recording material by a difference in the electrostatic capacity between a portion where the recording material exists and a portion where a recording material does not exist;

recognizing thickness of the recording material by detecting an amount of change in electrostatic capacity at a portion where the recording material is not placed; and recognizing a dielectric constant and a resistance of the recording material based on the thickness and the electrostatic capacity of a portion where the recording material is placed.

14. A method for recognizing whether or not a recording material exists and width and thickness of the recording material, comprising the steps of:

when the recording material passes between a first electrode and a second electrode, at least one of which being composed of a plurality of piezoelectric elements, arranged in a widthwise direction of the recording material, detecting a pressure between said first electrode and said second electrode at each piezoelectric element;

recognizing by detecting changes in pressure, whether or not the recording material has passed therethrough and the width of the recording material; and recognizing the thickness of the recording material by detecting an amount of change in pressure.

15. A method for recognizing whether or not a recording material exists and a width of the recording material, comprising the steps of:

in an image forming section of an image forming apparatus, wherein under an applied potential according to an image signal to an electrode array placed between a visualizing particle holding member for holding a visualizing particle by an electrostatic force or a magnetic force and a counter electrode facing the visualizing particle holding member, an electric field for selectively trajecting the visualizing particle toward the counter electrode from the visualizing particle holding member is generated in a vicinity of the visualizing particle holding member, when the recording material passes between the counter electrode and the electrode array, detecting an electrostatic capacity between the counter electrode and the electrode array at each electrode of the electrode array; and recognizing whether or not the recording material has passed therethrough and the width of the recording material based on a difference in electrostatic capacity between a portion at which the recording material is placed and a portion at which the recording material is not placed, between the counter electrode and the electrode array.

* * * * *